US007047960B2

(12) United States Patent
McCrea

(10) Patent No.: US 7,047,960 B2
(45) Date of Patent: May 23, 2006

(54) BOW STABILIZATION DEVICE

(76) Inventor: Jack Lynn McCrea, 11753 E. Wilson Rd., Miles, TX (US) 76861

( * ) Notice: Subject to any disclaimer, the term of this patent is extended or adjusted under 35 U.S.C. 154(b) by 0 days.

(21) Appl. No.: 10/680,151

(22) Filed: Oct. 8, 2003

(65) Prior Publication Data

US 2005/0076896 A1 Apr. 14, 2005

(51) Int. Cl.
*F41B 5/00* (2006.01)
*F16M 11/04* (2006.01)

(52) U.S. Cl. ..... 124/86; 248/177.1; 248/187.1

(58) Field of Classification Search ..... 124/86, 124/88, 89; 248/177.1, 186.1, 187.1
See application file for complete search history.

(56) References Cited

U.S. PATENT DOCUMENTS

| | | | | | |
|---|---|---|---|---|---|
| 256,540 | A * | 4/1882 | Browne | 248/649 |
| 755,403 | A * | 3/1904 | Sipe | 248/171 |
| 1,837,637 | A * | 12/1931 | Walberg | 84/421 |
| 1,894,457 | A * | 1/1933 | Zerk | 248/181.1 |
| 4,290,207 | A * | 9/1981 | Browning et al. | 33/295 |
| 4,674,472 | A * | 6/1987 | Reis | 124/89 |
| 5,205,272 | A * | 4/1993 | Boyer | 124/89 |
| 5,326,058 | A * | 7/1994 | Beaver et al. | 248/187.1 |
| 5,487,374 | A * | 1/1996 | Herminath et al. | 124/86 |
| 5,619,981 | A * | 4/1997 | Breedlove | 124/89 |
| 5,630,568 | A * | 5/1997 | Lubrecht | 248/217.4 |
| 6,070,569 | A * | 6/2000 | Chalin et al. | 124/86 |

* cited by examiner

*Primary Examiner*—John A. Ricci
(74) *Attorney, Agent, or Firm*—Jackson Walker LLP; Robert C. Klinger

(57) ABSTRACT

The present invention involves a compound bow sound dampening, stabilization and rest device which mounts to the front of a compound bow through the standard stabilizer bar connector (5/16-inch by #24 threaded bolt receiver). The bow stabilization device then connects to virtually all camera monopods, bipods and tripods using the camera mounting foot, which is attached through the standard camera connector (¼-inch by #20 threaded bolt). The mounting of the compound bow to the stabilization device through the camera monopod, bipod, or tripod enables freedom of movement and rotation on a variety of axes, while giving the archer the stability and support to make continued accurate placement of an arrow into a target.

10 Claims, 3 Drawing Sheets

BOW STABILIZATION DEVICE

CROSS-REFERENCE TO RELATED APPLICATIONS

Not Applicable

STATEMENT REGARDING FEDERALLY SPONSORED REASEARCH OR DEVELOPMENT

Not Applicable

REFERENCE TO SEQUENCE LISTING, A TABLE, OR A COMPUTER PROGRAM LISTING COMPACT DISK APPENDIX

Not Applicable

REFERENCE TO A MICROFICHE APPENDIX

Not Applicable

BACKGROUND OF THE INVENTION

Archery requires that numerous acts occur simultaneously for the accurate placement of an arrow into a target. The archer must hold the bow one-handed at a full arm extension while drawing the bowstring with the opposing arm to the full extension of the bowstring. The archer must then attempt to hold the bowstring at full extension while aligning the sighting device with the target. The archer then releases the bowstring while attempting to keep the bow steady and level until the arrow leaves the arrow rest en route to the target.

The invention is a stabilization device, which connects the compound bow to a camera monopod, bipod or tripod. This system will relieve the archer from attempting to hold the weight of the bow in a steady and level position at a full arm extension. This will allow the archer to focus on the bow's sighting device and proper release form. The archer can then concentrate on shot placement and shooting form with the reduction of stress from the weight of the bow and arm fatigue. The invention is also a sound dampening device. The invention allows the vibration of the bow to travel through the system to the surface that the archer is standing on.

BRIEF SUMMARY OF THE INVENTION

The bow stabilization device allows the bow to be attached to a camera monopod, bipod or tripod through a universal mounting footplate. The weight and stability of the bow is then transferred through the pod system to the shooting surface and not through the extension of the archer's arm. The position of the bow is established through the adjustments on the camera pod system. The device allows the archer to concentrate on sighting the bow, shooting form, and arrow placement. The bow stabilization device, through stabilization and bow weight reduction, is an excellent teaching aid for beginning archers, youth archers and archers with physical impairments, in addition to being particularly well suited for hunting, target shooting and sighting alignment of a compound archery bow.

DETAILED DESCRIPTION OF THE INVENTION

The bow stabilization device is a compound bow stabilizer rest system that is particularly well suited for hunting, target shooting and sighting alignment of a compound archery bow. The bow stabilization device will allow the archer to stabilize the bow and still have the freedom of movement on a variety of axes without sacrificing accuracy. The bow stabilization device will attach to virtually all camera monopods, bipods and tripod stands through a universal locking system.

Figure 2:
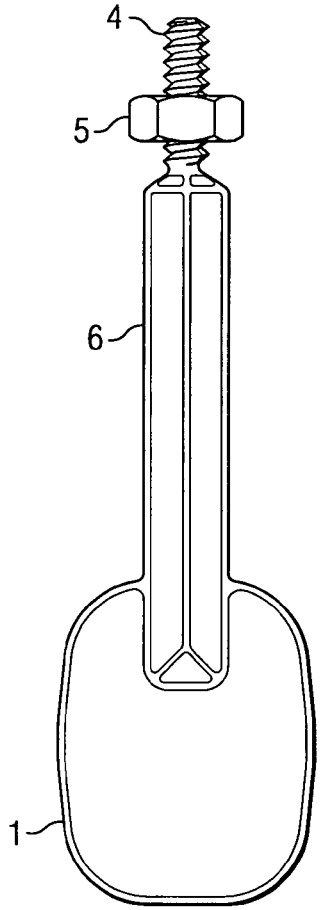
FIG. 2. Shows a top view of the bow stabilization device, with a permanently attached stabilizer bar.
Figure 3:
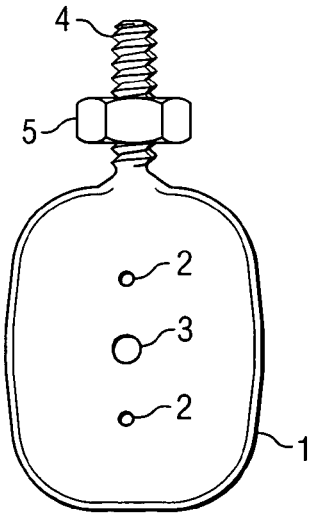
FIG. 3. Shows a bottom view of the bow stabilization device, without the stabilizer bar.
Figure 4:
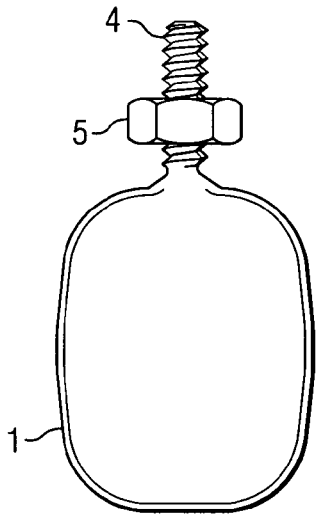
FIG. 4. Shows a top view of the bow stabilization device, without the stabilizer bar.

The bow stabilization device has a mounting footplate (FIGS. 3 and 4) which can be connected to a pre-existing stabilizer bar with the 5/16-inch by #24 threaded bolt (FIGS. 3 and 4) and is secured with the locking nut (FIGS. 3 and 4). The bow stabilization device can also be permanently attached to a stabilizer bar by weld (FIGS. 1 and 2) or manufactured as a single unit. The mounting footplate can be manufactured in any size, shape or weight of material capable of sustaining the weight of the bow. In the exemplified embodiment, the mounting footplate (FIGS. 1 and 4) measures approximately 2.5 inches in length by 2 inches in width and is composed of ¼-inch metal stock. The mounting footplate contains a ¼-inch by #20 thread-tapped hole (FIGS. 1 and 3) centered on the bottom of the mounting footplate. It also contains two 3/16-inch holes (FIGS. 1 and 3) located on either side of the ¼-inch by #20 thread-tapped holes, approximately ½-inch apart along the longitudinal axis. The two 3/16-inch holes accommodate the anti-rotation stud present on some pod systems and may or may not be utilized.

Figure 1:
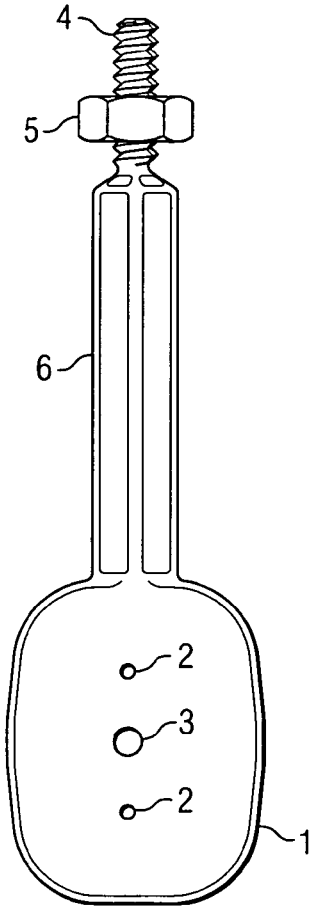
FIG. 1. Shows a bottom view of the bow stabilization device, with a permanently attached stabilizer bar.

In the exemplified embodiment, the permanently attached stabilizer bar (FIGS. 1 and 2) is ¾-inch metal cylindrical stock approximately five inches in length. One end is tapered and permanently affixed by weld to the mounting footplate (FIGS. 1 and 2). The opposing end is tapered and tapped to receive a 5/16-inch by #24 threaded bolt (FIGS. 1 and 2). The bolt extends approximately one inch from the stabilizer bar and is permanently affixed by weld. The stabilizer can also be drilled and tapped to receive a 5/16-inch by #24 all-thread bolt. The bolt is accompanied by a 5/16-inch by #24 threaded lock nut (FIGS. 1–4, #5). The lock nut is used to vise the bow stabilization device in position while attached to the bow.

The bow stabilization device can be permanently affixed as one unit by weld or may be manufactured as a one-unit piece. The bow stabilization device is covered with a plastic or rubber coating for sound and vibration reduction and for weather proofing. It may also be coated with any other type of coating product (i.e. paint).

Figure 5:
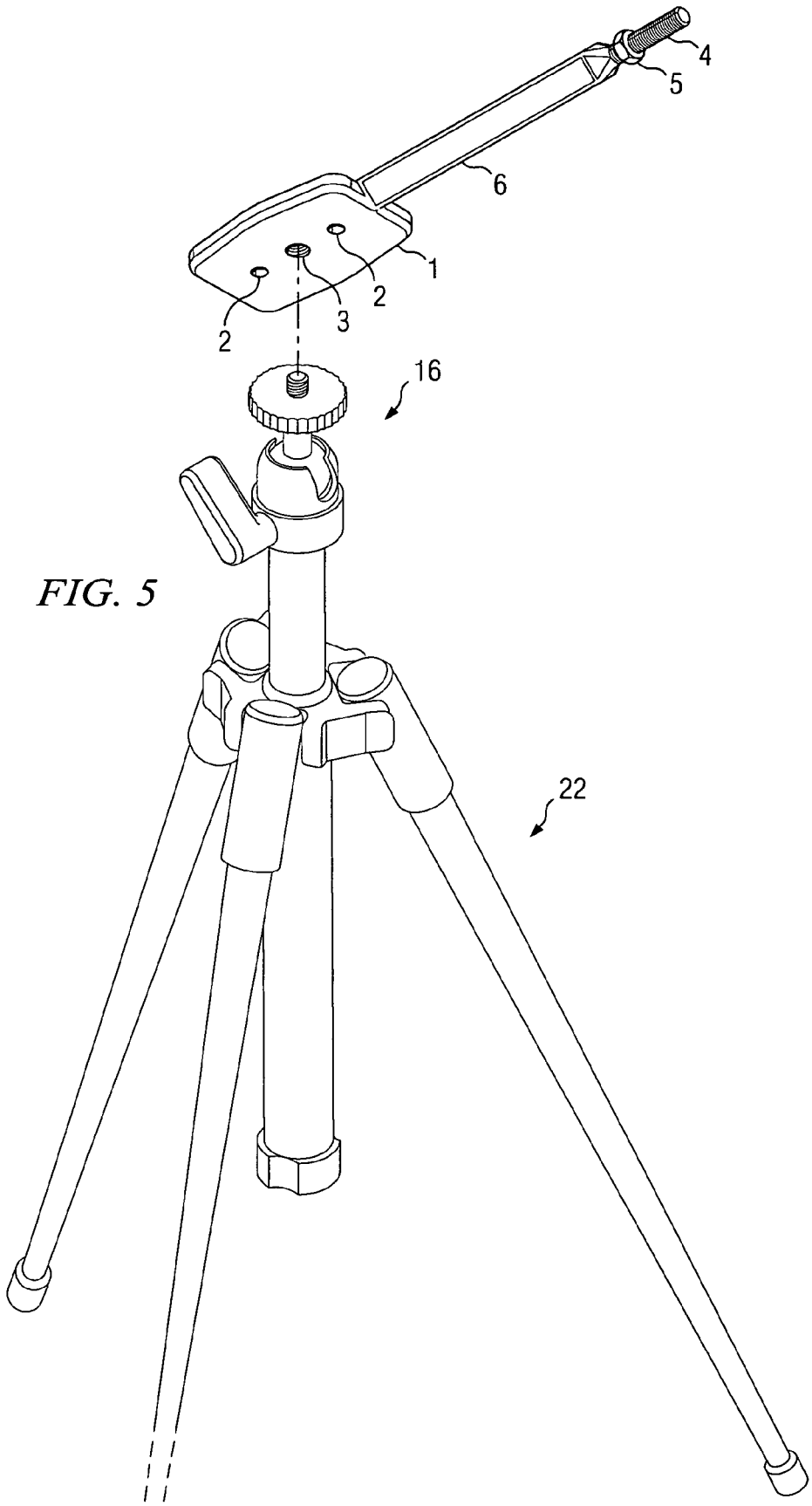
FIG. 5 is a view of the bow stabilization device placed on top of a camera tripod.
Figure 6:
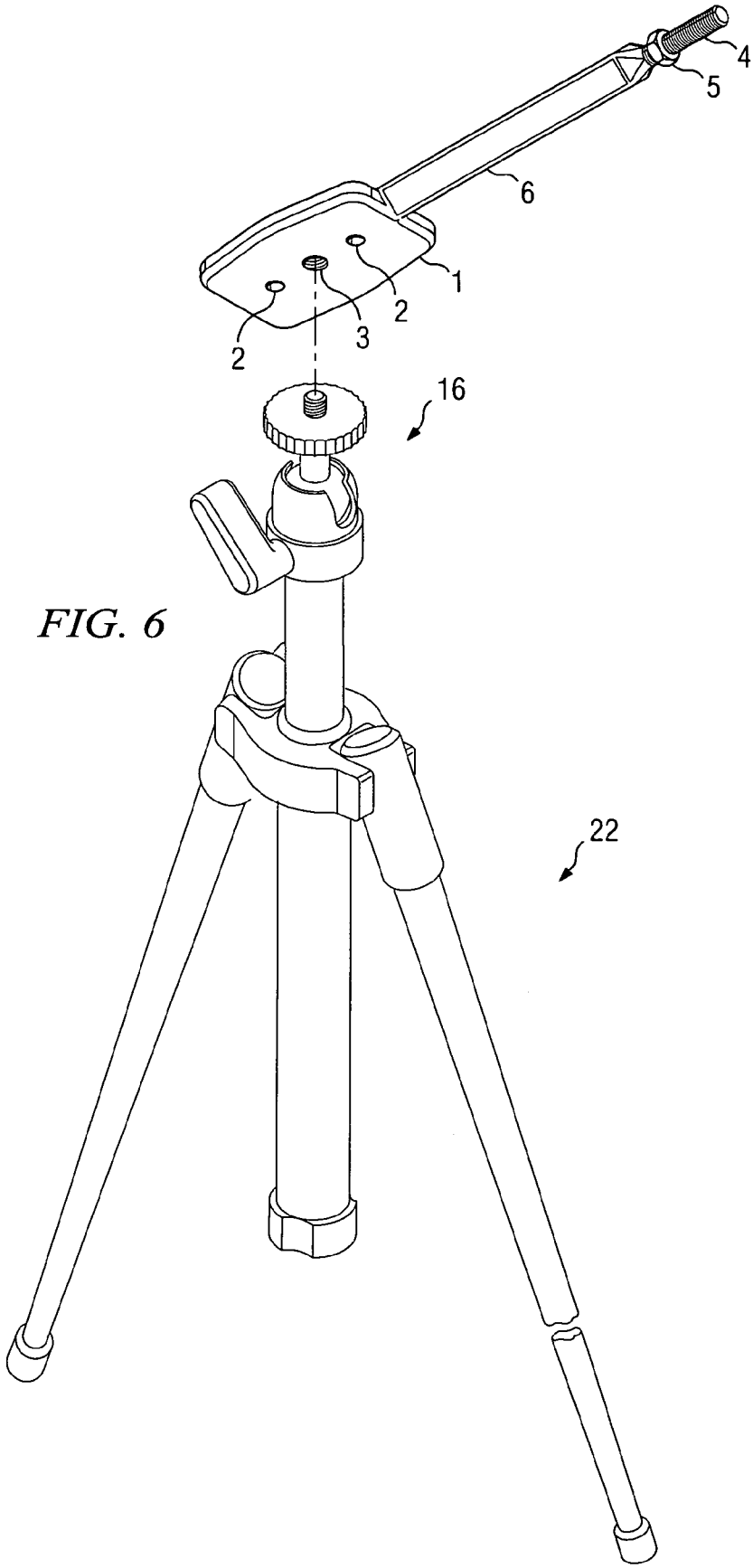
FIG. 6 is a view of the bow stabilization device placed on top of a camera bipod.

The bow stabilization device's mounting footplace (FIGS. 1 and 4) is locked into place on top of the camera monopod, bipod (FIG. 6) or tripod base plate (FIG. 5) of the pod system by tightening the standard ¼-inch by #20 threaded bolt into the bow stabilization device's mounting footplate receiver hole (FIGS. 1 and 3). The bow stabilization device is then secured to the compound bow, utilizing the 5/16-inch by #24 threaded bolt (FIGS. 1–4, #4) and a 5/16-inch by #24 threaded locking nut (FIGS. 1–4, #5,) through the stabilizer receiver hole present on the bow.

Once the bow stabilization device is securely attached to the compound bow, the unit can be adjusted for height utilizing the adjustment leg(s) of the different types of pod systems. The unit can then be adjusted individually for sight alignment both horizontally and vertically by utilizing the pod system's swivel adjustments. After the adjustments have been completed, the archer can use the unit for hunting, sighting in the bow, target shooting and other sporting activities in a safe, confident, and accurate manner. The bow stabilization device can also be detached from the pod system and used as a stabilizing/balancing unit.

It should be understood that the examples and embodiments described herein are for illustrative purposes only and that various modifications or changes in light thereof will be suggested to persons skilled in the art of archery.

What is claimed is:

1. A bow support adapted to be secured to a pod mounting portion, comprising:

a member having a first portion adapted to securely couple to a bow, and a second portion adapted to be directly coupled to the pod mounting portion such that the bow is oriented in a vertical position when the pod is securely positioned on the ground, wherein the member second portion has a first threaded recess adapted to treadably receive the pod mounting portion, wherein the member has a third portion proximate the second portion also adapted to be coupled to the pod mounting portion so as to inhibit rotation of the member with respect to the pod mounting portion.

2. The support as specified in claim 1, wherein the member is a unitary member.

3. The support as specified in claim 2 wherein the first and second portions are located at opposite ends of the unitary member.

4. The support as specified in claim 1 wherein the bow is a compound bow.

5. In combination a tripod having a mounting portion; and a member having a first portion adapted to securely couple to a bow, and a second portion adapted to be directly coupled to the tripod mounting portion such that the bow is oriented in a vertical position when the tripod is securely positioned on the ground, wherein the member second portion has a first threaded recess adapted to treadably receive the pod mounting portion.

6. The combination as specified in claim 5, wherein the member is a unitary member.

7. The combination as specified in claim 6, wherein the first and second portions are located at opposite ends of the unitary member.

8. The combination as specified in claim 5, wherein the bow is a compound bow.

9. The combination as specified in claim 5, wherein the member has a third portion proximate the second portion also adapted to be coupled to the pod mounting portion so as to inhibit rotation of the member with respect to the pod mounting portion.

10. In combination a bipod having a mounting portion; and a member having a first portion adapted to securely couple to a bow, and a second portion adapted to be directly coupled to the bipod mounting portion such that the bow is oriented in a vertical position when the bipod is securely positioned on the ground, wherein the member second portion has a first threaded recess adapted to treadably receive the pod mounting portion.

* * * * *